US006393732B1

(12) United States Patent
Kita

(10) Patent No.: US 6,393,732 B1
(45) **Date of Patent: *May 28, 2002**

(54) ATHLETIC SHOE MIDSOLE DESIGN AND CONSTRUCTION

(75) Inventor: Kenjiro Kita, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/590,531

(22) Filed: Jun. 8, 2000

(30) Foreign Application Priority Data

Feb. 25, 2000 (JP) ..... 2000-049106

(51) Int. Cl.[7] ..... A43B 13/12
(52) U.S. Cl. ..... 36/30 R; 36/3 B; 36/102
(58) Field of Search ..... 36/30 R, 3 B, 36/102, 28, 29, 27

(56) References Cited

U.S. PATENT DOCUMENTS

| | | | | |
|---|---|---|---|---|
| 1,219,890 | A | * | 3/1917 | West |
| 1,504,908 | A | * | 8/1924 | Sato |
| 2,098,412 | A | | 11/1937 | Bovay |
| 2,334,719 | A | * | 11/1943 | Margolin |
| 3,284,930 | A | * | 11/1966 | Baldwin |
| 4,063,371 | A | * | 12/1977 | Batra |
| 4,674,200 | A | | 6/1987 | Sing |
| 4,813,160 | A | * | 3/1989 | Kuznetz |
| 4,888,887 | A | * | 12/1989 | Solow |
| 4,912,858 | A | * | 4/1990 | Mochizuki |
| 4,939,851 | A | * | 7/1990 | Miller |
| 5,255,451 | A | * | 10/1993 | Tong et al. |
| 5,400,526 | A | | 3/1995 | Sessa |
| 6,041,519 | A | * | 3/2000 | Cheng |
| 6,092,305 | A | | 7/2000 | Troy et al. |
| 6,205,681 | B1 | * | 3/2001 | Kita |

FOREIGN PATENT DOCUMENTS

| | | | |
|---|---|---|---|
| EP | 0 985 752 A1 | * | 11/1999 |
| EP | 0 963 711 A1 | * | 12/1999 |
| JP | 63-43923 | | 11/1988 |
| JP | 8-131204 | | 5/1996 |
| JP | 11-346803 | * | 12/1999 |

* cited by examiner

*Primary Examiner*—Ted Kavanaugh
(74) *Attorney, Agent, or Firm*—W. F. Fasse; W. G. Fasse

(57) ABSTRACT

A midsole assembly for an athletic shoe includes a midsole formed of soft elastic material, a corrugated sheet interposed in the heel portion of the midsole, a plurality of transverse holes formed at the contact regions of the midsole with the corrugated sheet, and through holes extending vertically and communicating with transverse holes. In using this shoe, air flows into the shoe through the transverse holes and the through holes. Thus, good ventilation can be acquired especially at the heel portion of the inside of the shoe. The corrugated sheet maintains the shape of the transverse holes and prevents them from being crushed by the impact load applied onto the midsole at the time of impacting the ground so that ventilation can be secured in a highly loaded athletic shoe.

18 Claims, 10 Drawing Sheets

ATHLETIC SHOE MIDSOLE DESIGN AND CONSTRUCTION

BACKGROUND OF THE INVENTION

The present invention relates to an athletic shoe midsole design and construction, and more particularly, to a midsole assembly having a vent or vent hole formed in a midsole.

The sole of an athletic shoe is generally comprised of a midsole and an outsole. The midsole is typically formed of soft elastic material in order to ensure adequate cushioning properties. The outsole is fitted under the midsole and directly contacts with the ground.

Preferably, ventilation of a shoe is required in a degree when wearing a shoe. Various kinds of shoes with vent holes have conventionally been proposed.

For instance, the Japanese patent application laying open publication No. 8-131204 discloses a plurality of transverse holes formed at a body portion of the bottom member of a shoe and a plurality of vertical holes also formed at a body portion of the bottom member. The vertical holes communicate with the transverse holes and penetrating through the insole. The Japanese utility model application examined publication No. 63-43923 shows a plurality of through holes penetrating through the upper member of a sole in the thickness direction and a plurality of grooves formed at the lower member of the sole. Each of the grooves corresponds to each of the through holes.

In both cases, the air flows into a shoe through the transverse holes and the vertical holes, or the through holes and the grooves. Thus, ventilation of the inside of a shoe is acquired.

In the prior art construction, however, transverse holes or grooves are merely formed on the body portion or the lower member made of rubber or the like. Thus, in the case of an athletic shoe to which impact load is applied at the time of impacting the ground, the transverse holes or the grooves are deformed and crushed by the compressive deformation of the body portion or the lower member. As a result, ventilation of the inside of a shoe is interrupted.

The object of the present invention is to provide a midsole assembly for an athletic shoe that can ensure ventilation of a shoe.

SUMMARY OF THE INVENTION

The present invention provides a midsole assembly for an athletic shoe.

In one embodiment, a midsole assembly comprises a midsole formed of soft elastic material, a transverse hole extending laterally and formed at least at the heel portion of the midsole, a retention member for retaining the shape of the transverse hole, and a vent hole extending vertically and communicating with the transverse hole and having an open end on the plantar contact face of the heel portion of the midsole.

In another embodiment, the profile of the retention member conforms to at least a portion of the sectional shape of the transverse hole and the retention member is arcuate, semi-circular, or circular in cross section.

In still another embodiment, the retention member is formed of a corrugated sheet interposed in at least the heel portion of the midsole, and the transverse hole is formed at the contact regions of the midsole with the corrugated sheet.

In a further embodiment, a vertically extending through hole is formed at a midfoot portion, or a plantar arch portion of a midsole, and a longitudinally extending vent passage, in connection with the vertically extending through hole, is formed at a forefoot portion of a midsole. Besides, a vertically extending vent hole, in communication with the longitudinally extending vent passage, is formed at the forefoot portion and open at the plantar contact face of the forefoot portion of the midsole.

In a still further embodiment, the openings of the vertically extending vent holes, formed on the bottom side of the forefoot portion, are aligned in a general shoe width direction, and a groove extending in a general shoe width direction, in connection with these openings, is formed on the bottom side of the forefoot portion.

In an additional embodiment, a vertically extending through hole is formed at a midfoot portion of a midsole, and a groove extending in a general shoe width direction, in communication with the vertically extending through hole, is formed at the midfoot portion.

In a preferred embodiment, a midsole assembly comprises a midsole formed of soft elastic material, a corrugated sheet interposed in at least the heel portion of the midsole, a plurality of laterally extending transverse holes formed at the contact regions of the midsole with the corrugated sheet, and a plurality of vertically extending vent holes, in communication with the transverse holes, formed and open at the plantar contact face of the heel portion of the midsole. A midsole assembly of this embodiment further comprises a vertically extending through hole formed at the midfoot portion of the midsole, a longitudinally extending groove, in connection with the vertically extending through hole at the midfoot portion, formed at the forefoot portion of the midsole, and a plurality of vertically extending vent holes, in communication with the longitudinally extending groove at the forefoot portion, formed at the forefoot portion of the midsole and open at the plantar contact face of the forefoot portion. A midsole assembly of this embodiment still further comprises a concave, or a recess, formed at an opening portion of the vertically extending through hole on the bottom side of the midfoot portion, and a cover portion covering a portion of the concave, formed at a portion of the corrugated sheet and disposed oppositely to the opening portion of the vertically extending through hole.

In use of a shoe, the air is introduced into the shoe through a transverse hole formed at the heel portion of a midsole and a vent hole communicating with the transverse hole, and thus, ventilation can be acquired inside the shoe, especially at the heel portion. Moreover, in this case, because a retention member for retaining the shape of the transverse hole is provided, the transverse hole can be prevented from being deformed and crushed even when a midsole is compressively deformed by the impact load at the time of impacting the ground. Thus, even in an athletic shoe, ventilation can be realized and secured.

When the retention member is formed of a corrugated sheet, which is hard to be deformed, by the action of the corrugated sheet, compressive deformation of the midsole is restrained and the shape of the transverse hole is maintained. Thus, the transverse hole can be prevented from being deformed and crushed even in the case of impact loading onto the midsole. Also, the heel portion of the midsole can be prevented from being deformed transversely by the action of the corrugated sheet, which makes it possible to achieve running stability at the time of impacting the ground.

Moreover, the corrugated sheet allows for smooth restoration of the transverse hole after deformation, and as a result, efficient ventilation can be attained by the pumping action. Furthermore, when the corrugated sheet with higher elasticity is used, the transverse hole becomes hard to be worn, and ventilation of a shoe can be maintained during a prolonged period.

When a vertically extending through hole is formed at a midfoot portion, or a plantar arch portion, the air is introduced into a shoe through this through hole, and thus, ventilation can be attained inside a shoe, especially at the midfoot portion. Moreover, in this case, because the air is introduced into a shoe through the vertically extending through hole to a longitudinally extending air passage such as a groove at the midfoot portion and to an air vent hole at a forefoot portion, ventilation can be attained inside the shoe at the forefoot portion as well.

When the openings of the air vent holes on the bottom side of the forefoot portion are aligned in a width or lateral direction, and a laterally extending groove, in communication with these openings, is formed on the bottom side of the forefoot portion, flexibility of the forefoot portion of the midsole can be improved by this groove.

When a laterally extending groove and a vertically extending through hole are formed at a midfoot portion, the air is introduced into a shoe through this groove and this through hole, and thus, ventilation can be acquired inside the shoe, especially at the midfoot portion.

When a corrugated sheet, or a wavy sheet, is provided in the midsole, compressive deformation of the midsole is restrained, and the shape of a transverse hole is maintained. Thus, even in the case of impact loading onto the midsole, deformation of the transverse hole can be prevented and ventilation can be secured inside a shoe, especially at the heel portion. Besides, transverse deformation of the heel portion of the midsole can be prevented and running stability can be secured at the time of impacting the ground.

Also, in this case, ventilation is attained at the midfoot portion as well through a vertically extending through hole. Besides, ventilation at the forefoot portion is acquired through a vertically extending vent hole formed at the forefoot portion.

Moreover, the opening portion of the through hole on the bottom side can be prevented from being exposed to the ground by a cover portion, which is disposed oppositely to the opening portion of the through hole, and covers a portion of a recess on the bottom side of the midfoot portion.

Thus, water, sand, dust or the like outside a shoe is restrained from entering the inside of the shoe via a through hole at the midfoot portion at the time of impacting the ground. As a result, this shoe can be used as an outdoor shoe.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
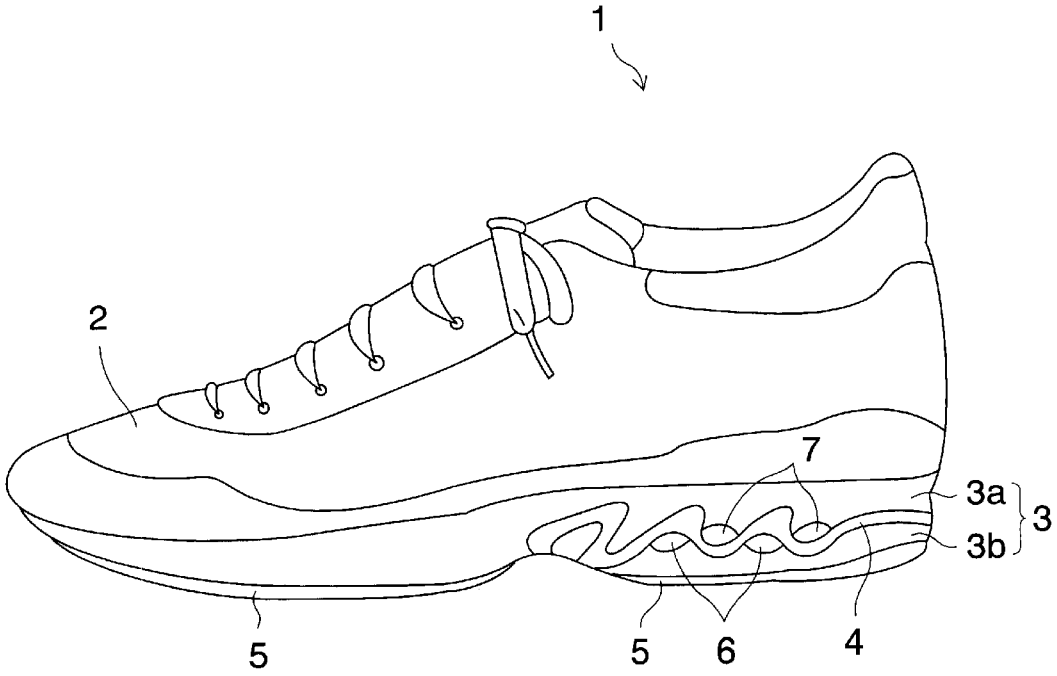
FIG. 1 is a lateral side view of an athletic shoe (left foot side) incorporating the midsole construction of the present invention.

Turning now to the drawings, FIG. 1 illustrates an athletic shoe incorporating the midsole construction of the present invention. The sole of this athletic shoe 1 comprises a midsole 3, a corrugated sheet 4 and an outsole 5 directly contacting with the ground. The midsole 3 is fitted to the bottom of an upper 2. The corrugated sheet 4 having a wavy configuration is interposed in the midsole 3. The outsole 5 is fitted to the bottom of the midsole 3.

The midsole 3 is provided in order to absorb impact load imparted on the bottom of the shoe 1 when an athlete strikes down onto the ground. The midsole 3 is comprised of an upper midsole 3*a* and a lower midsole 3*b* that are respectively disposed on the top and bottom surfaces of the corrugated sheet 4. That is, the corrugated sheet 4 is interposed between the upper midsole 3*a* and the lower midsole 3*b,* and the sheet 4 is integrated with the upper and lower midsoles 3*a,* 3*b.* Also, the upper midsole 3*a* extends from the heel portion to the forefoot portion of a shoe 1, whereas the lower midsole 3*b* is disposed mainly at the heel portion.

The midsole 3 is generally formed of soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber are used.

The corrugated sheet 4 is preferably formed of thermoplastic resin such as thermoplastic polyurethane (TPU) of comparatively rich elasticity, polyamide elastomer (PAE), ABS resin or the like. Alternatively, the corrugated sheet 4 is formed of thermosetting resin such as epoxy resin, unsaturated polyester resin and the like. The corrugated sheet may be formed of a plate made of elastic metal, or a meshed sheet made of elastic metal fibers.

At the contact portions of the midsole 3 with the corrugated sheet 4 are formed a plurality of transverse holes 6, 7 extending laterally (into the page of FIG. 1).

Figure 2:
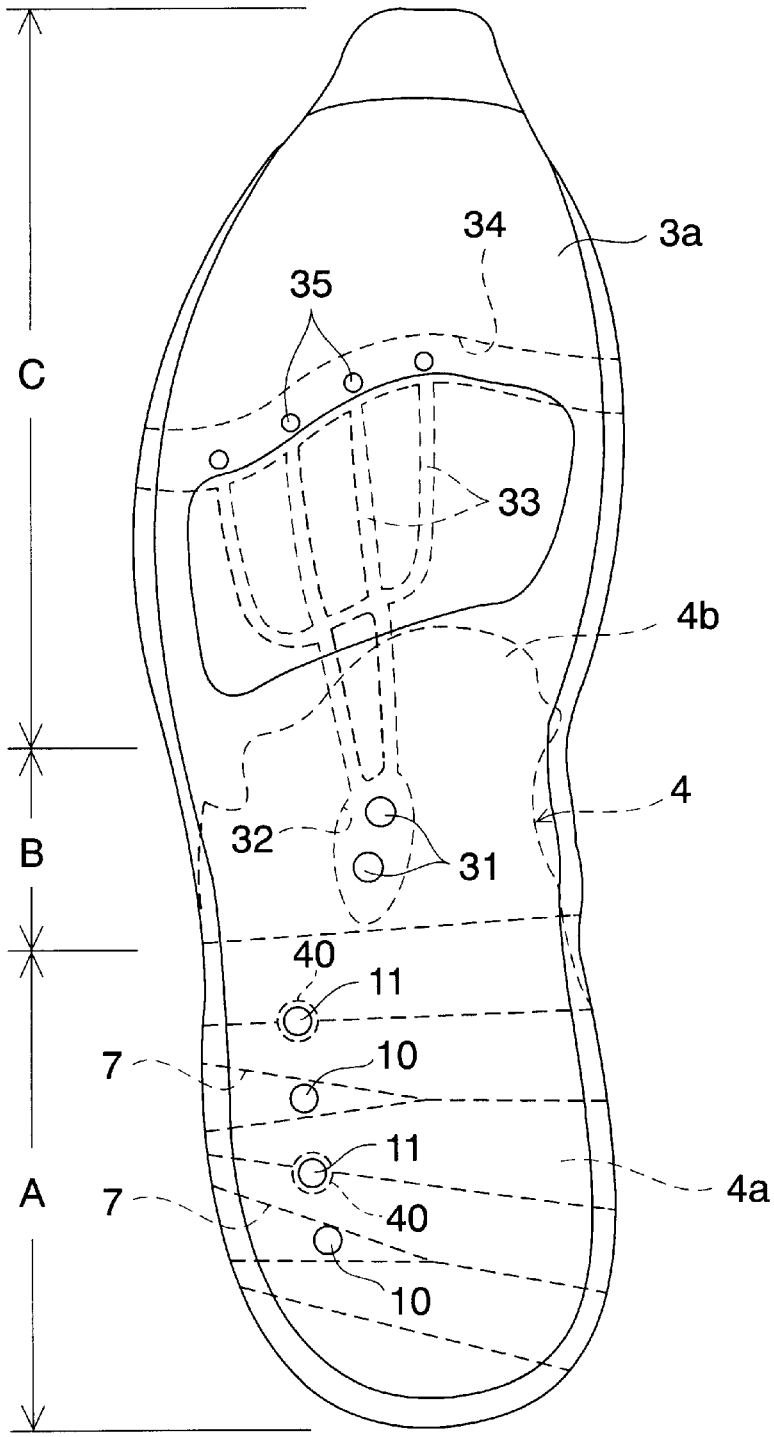
FIG. 2 is a top plan view of the left foot side midsole construction present invention.

As shown in FIGS. 2–5, the corrugated sheet 4 extends from the heel portion A to the midfoot portion B, or a planter arch portion, of the midsole 3, and it is comprised of a heel portion 4*a* having a corrugated configuration and a generally planar midfoot portion 4*b* formed integrally with the heel portion 4*a.* The broken lines extending in the lateral direction at the heel portion 4*a* of FIG. 2 respectively show a crest or a trough of the corrugation of the corrugated sheet 4.

As is clearly seen from FIGS. 2–5 and 8, the transverse hole 6 penetrates through the lower midsole 3*b* laterally, or extends from the medial side to the lateral side of the lower midsole 3*b,* whereas the transverse hole 7 extends from the lateral side to the central portion of the upper midsole 3*a,* and has an opening end on the lateral side and a closed end on the central portion of the upper midsole 3*a*. The transverse holes 6, 7 are easy to be formed, because these holes are formed on the contact faces between the upper and lower midsoles 3*a*, 3*b* with the corrugated sheet 4 therebetween in the embodiment of FIGS. 1 to 8.

In addition, these transverse holes 6, 7 are originally provided in order to cause the corrugated sheet to deform easily at the formed portions of the transverse holes to improve the cushioning properties at the time of impacting the ground, and in order to make the whole midsole lighter in weight, as shown in Japanese patent application laying open publication No. 11-346803.

Figure 3:
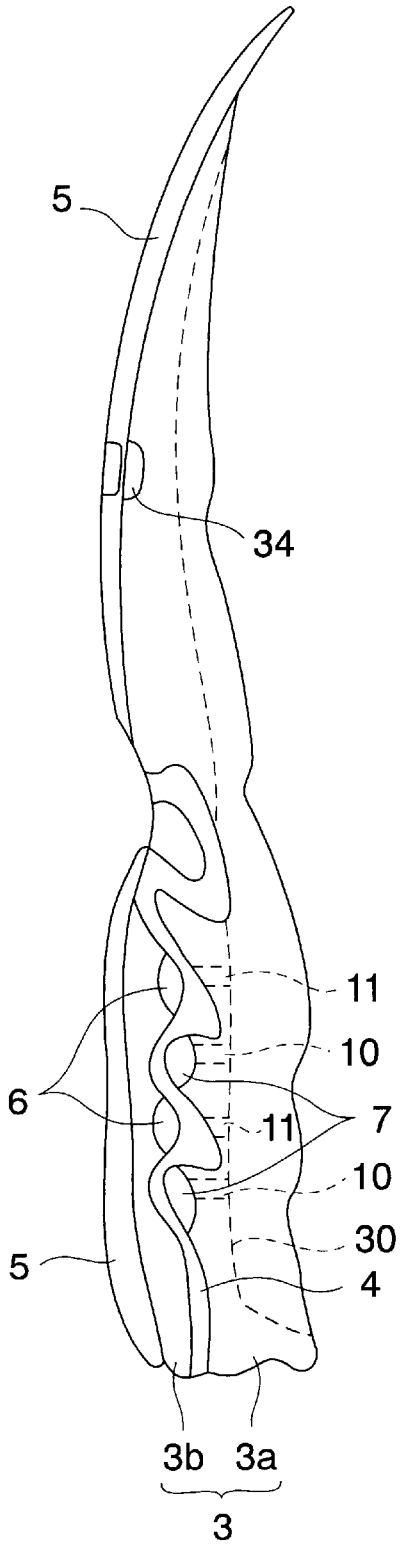
FIG. 3 is a lateral side view of the midsole construction of FIG. 2.
Figure 4:
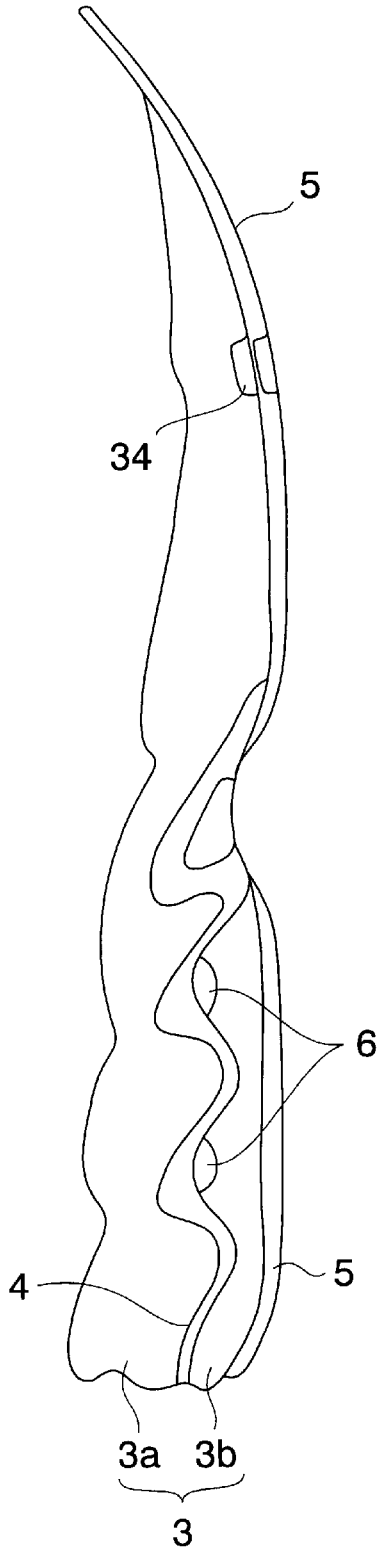
FIG. 4 is a medial side view of the midsole construction of FIG. 2.

As shown in FIGS. 2 and 3, the upper midsole 3*a* is formed with a plurality of vertically extending through holes 10, or vent holes, communicating with the transverse holes 7 and having opening ends on the planter contact face 30 of the heel portion A of the upper midsole 3*a*. Similarly, the upper midsole 3*a* is formed with a plurality of vertically extending through holes 11 or vent holes, communicating with the transverse holes 6 via holes 40 (FIG. 7) formed in the corrugated sheet 4 and having opening ends on the planter contact face 30 of the heel portion A of the upper midsole 3*a*. At least either one of the through holes 10, 11 is provided in this embodiment.

As mentioned above, the transverse holes 6, 7 are formed on the contact faces between the upper and lower midsoles 3*a*, 3*b*, i.e. the contact faces of the upper and lower midsoles 3*a*, 3*b* with the corrugated sheet 4, in the embodiment of FIGS. 1 to 8. This allows the through holes 10, 11 to be formed only in the upper midsole 3*a* and the corrugated sheet 4, and the through holes 10, 11 can be formed with ease.

Figure 8:
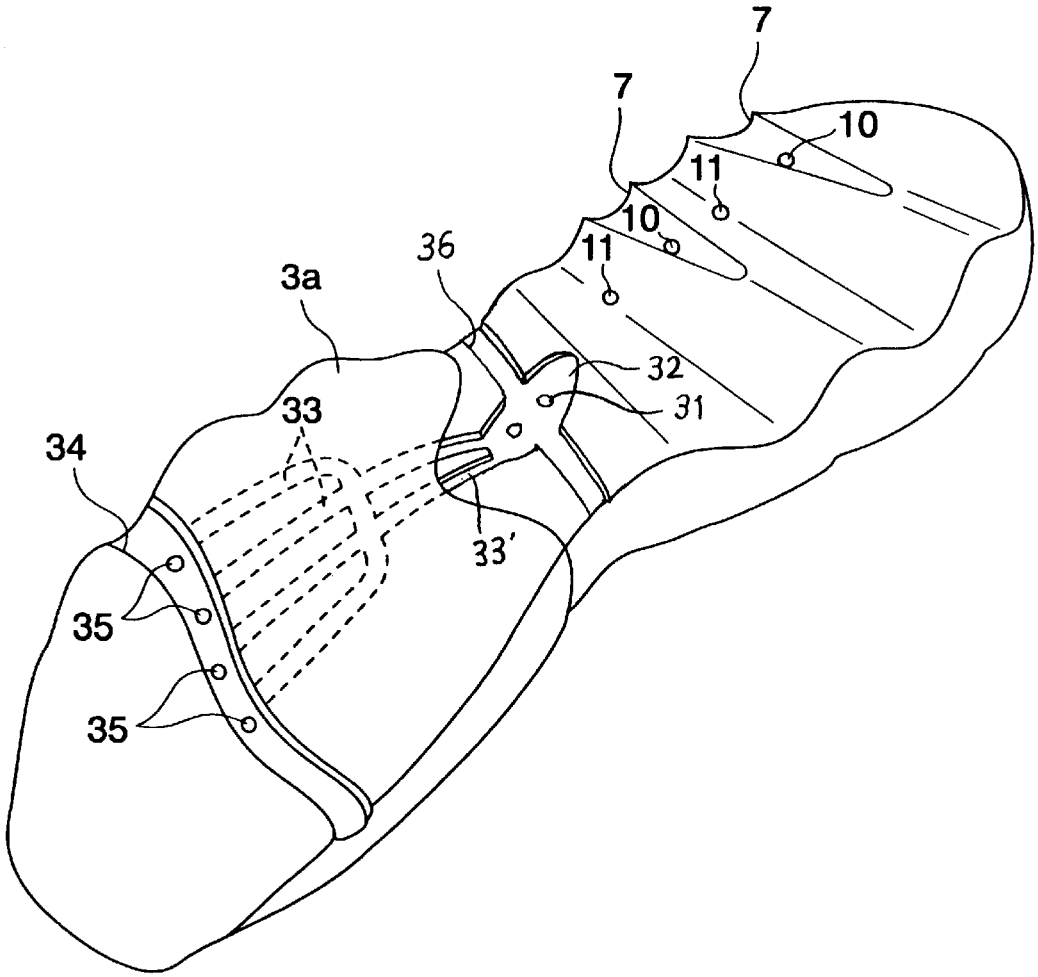
FIG. 8 is a perspective view of the upper midsole of the midsole construction of FIG. 2, showing the bottom side of the upper midsole without a corrugated sheet.

The midfoot portion B of the upper midsole 3*a*, shown in FIGS. 2 and 8, is formed with a vertically extending through hole 31. A concave portion, or a recess 32, is formed at the opening portion of the through hole 31 on the bottom side. On the plantar contact side of the forefoot portion C of the upper midsole 3*a* are provided a plurality of grooves 33 extending longitudinally and communicating with the recess 32. The grooves 33 are connected with the recess 32 via grooves 33' in connection with the recess 32 and formed on the bottom side of the midfoot portion B.

A groove 34 extending in the generally lateral direction, or the generally shoe width direction, is formed on the bottom surface of the forefoot portion C of the upper midsole 3*a*. A plurality of through holes 35, or vent holes, penetrating vertically through the upper midsole 3*a* are formed in the groove 34, and the through holes 35 are in connection with the groove 33. The groove 33 may be formed on the bottom side of the forefoot portion C of the upper midsole 3*a*. Alternatively, a longitudinally extending vent passage formed inside the forefoot portion C of the upper midsole 3*a* may take the place of the groove 33.

Figure 5:
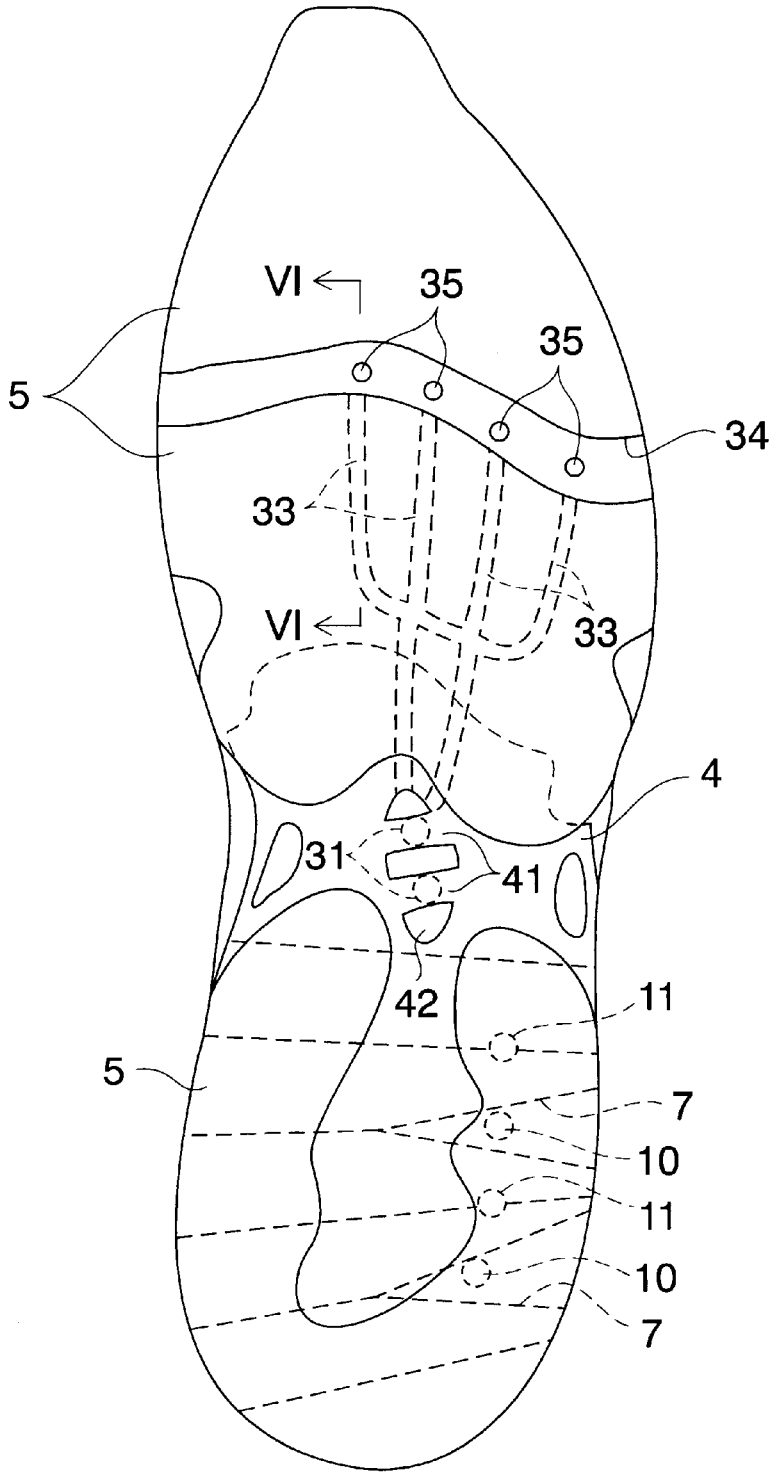
FIG. 5 is a bottom view of the midsole construction of FIG. 2.
Figure 6:
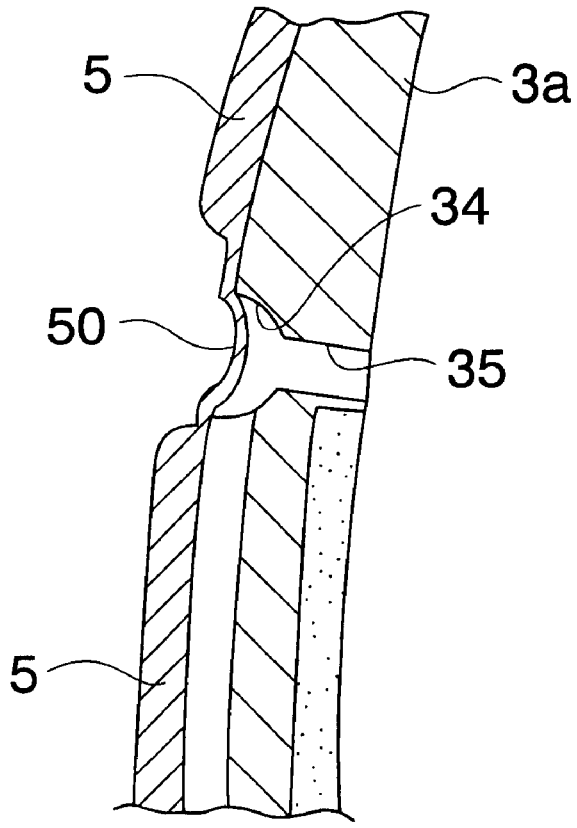
FIG. 6 is a cross sectional view of FIG. 5 taken along line VI—VI.

As shown in FIG. 6, a cover 50 made of transparent resin (not shown in FIGS. 5, 7 and 8) is provided at the opening portion of the groove 34. This cover 50 prevents water, sand or the like outside a shoe from being soaked or introduced into the inside of the shoe through the opening portion of the through hole 35 on the bottom side when the shoe contacts with the ground. The groove 34 improves the flexibility of the forefoot portion of the midsole. The laterally extending groove 36 similar to the groove 34 may be formed at the recess 32 of the midfoot portion B (see FIG. 8).

Figure 7:
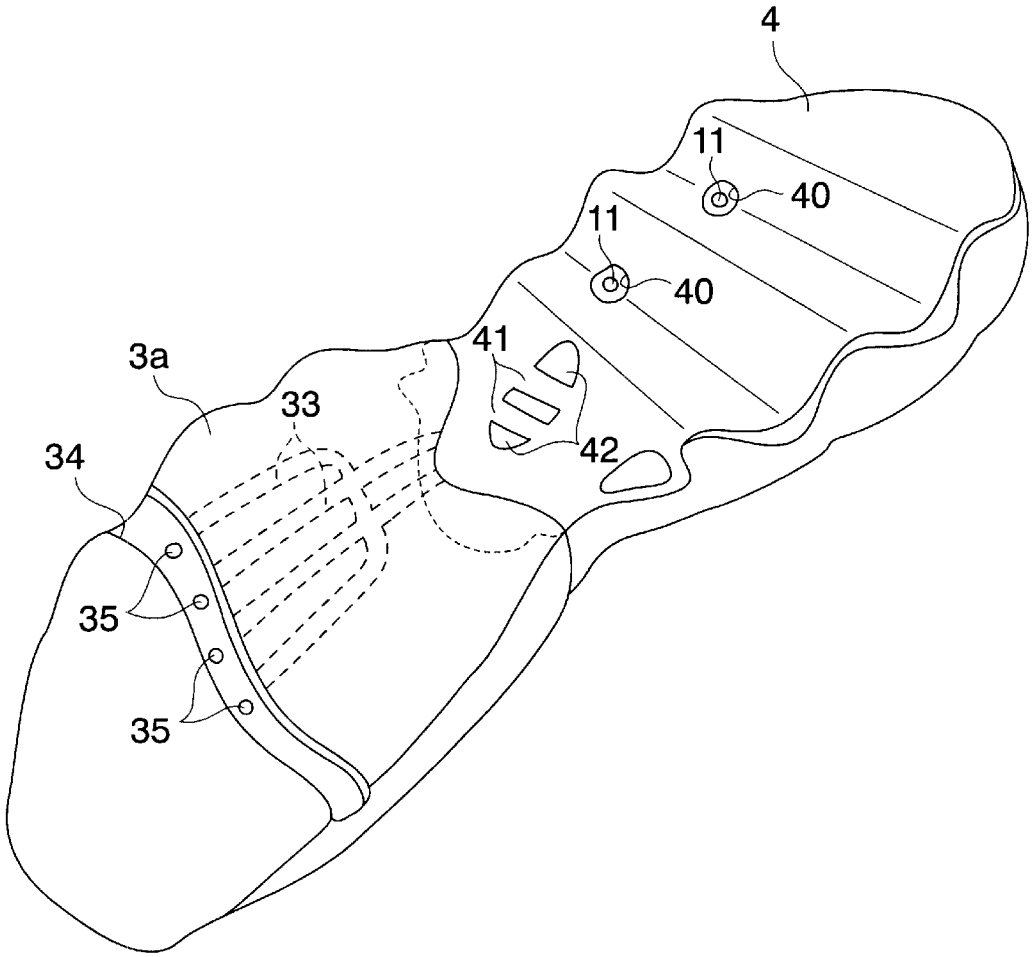
FIG. 7 is a perspective view of the upper midsole of the midsole construction of FIG. 2, showing a corrugated sheet fitted on the bottom side of the upper midsole.

As shown in FIGS. 5 and 7, at the portion of the corrugated sheet 4 corresponding to the recess 32 at the midfoot portion B of the upper midsole 3*a* are formed holes 42 and band-like cover portions 41, each of which is positioned against, i.e. directly below the opening portion of a respective through hole 31.

In use of the shoe 1, the air is introduced into the inside of the shoe through the transverse holes 6, 7 formed at the heel portion of the midsole 3 and the through holes 10, 11 communicating with these holes 6, 7. Thus, ventilation can be acquired inside the shoe, especially at the heel portion.

Also, in this case, because the compressive deformation of the midsole 3 is restrained by the action of the corrugated sheet 4 provided at the heel portion of the midsole 3, and the corrugated sheet 4 itself supports the shape of the transverse holes 6, 7, the holes 6, 7 are prevented from being crushed by the impact load applied onto the midsole 3 and thus, ventilation can be attained inside the shoe 1, especially at the heel portion. Besides, transverse deformation of the heel portion of the midsole 3 is prevented and running stability can be secured at the time of impacting the ground.

Moreover, smooth restoration of the deformed transverse holes 6, 7 can be attained by the action of the corrugated sheet 4, which causes pumping action, thereby acquiring efficient ventilation. Also, when the corrugated sheet with rich elasticity is used, the transverse holes 6, 7 become hard to be worn and shrunk, which enables to maintain prolonged ventilation of the shoe. The fiber reinforced plastics or metal may be used as a member with rich elasticity.

Furthermore, the air is introduced or flown into the inside of the shoe 1 through the hole 42 of the corrugated sheet 4 and the openings of the vertically extending through holes 31 at the midfoot portion of the midsole 3, thereby allowing for ventilation inside the shoe, especially at the midfoot portion, or plantar arch portion. Besides, the air is introduced into the forefoot portion not only through the recess 32 of the midfoot portion to the groove 33 and the through hole 35 but through the groove 34 of the forefoot portion and the through hole 35. Thus, ventilation of the forefoot portion inside the shoe can be acquired.

Also, in this case, the cover portion 41 of the corrugated sheet 4 covers a portion of the recess 32 of the midfoot portion and is positioned against the opening portion of the through hole 31, thereby preventing the opening portion of the through hole 31 from being directly exposed to the ground. Thus, water, sand, dust and the like outside the shoe are hindered from entering the inside of the shoe. As a result, the shoe 1 can be used as an outdoor shoe.

Additionally, in this embodiment, the shoe 1 is ventilated through the transverse holes 6, 7 originally provided for improving the cushioning properties of the midsole 3, which is different from the conventional shoe with the conventional vent holes. Thus, aesthetic appearance of a shoe will not be impaired.

Figure 9:
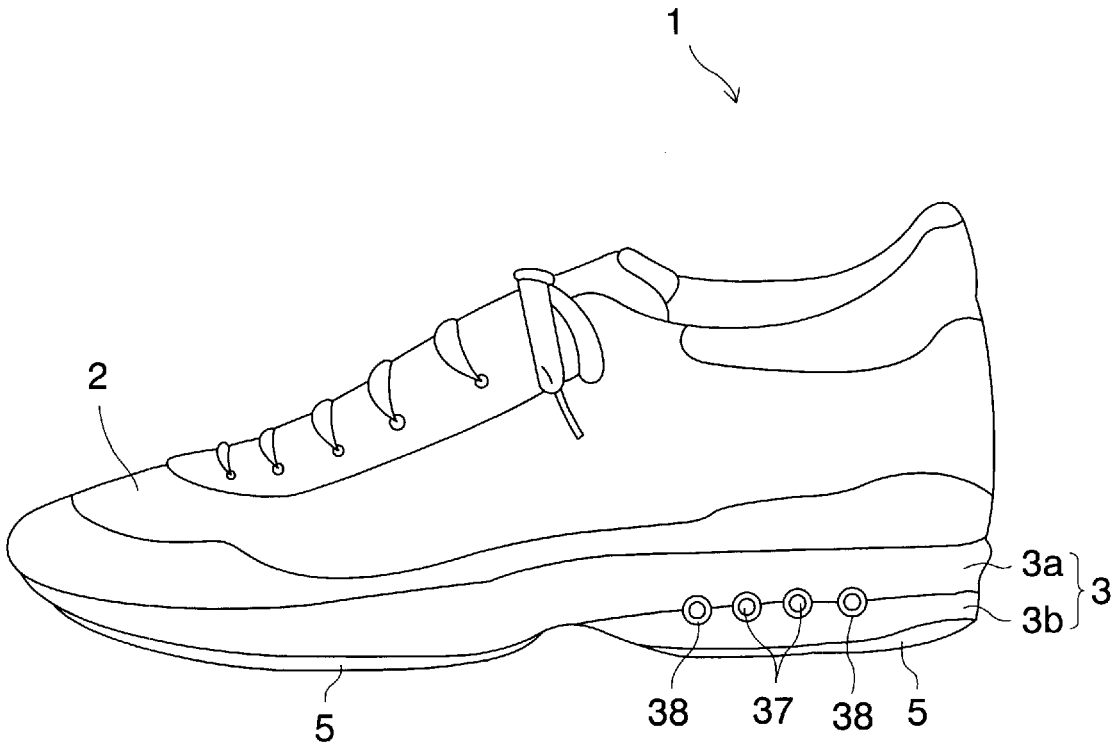
FIG. 9 is a lateral side view of an athletic shoe (left foot side) incorporating another embodiment of the midsole construction the present invention.
Figure 10:
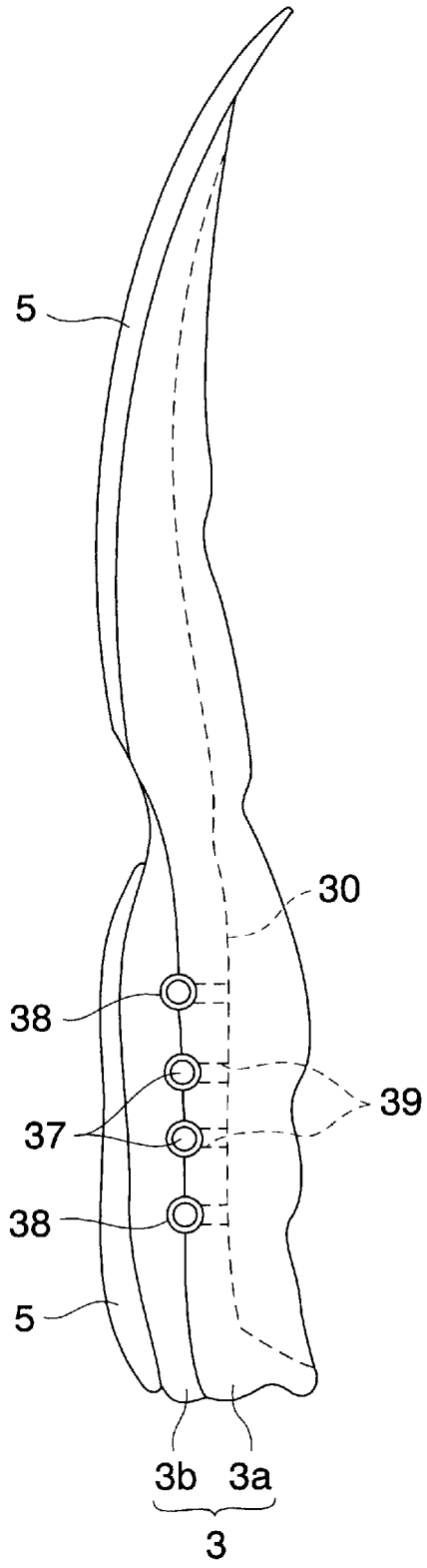
FIG. 10 is a lateral side view of the midsole construction of FIG. 9.

FIGS. 9 and 10 depict an alternative embodiment of the midsole construction of the present invention. As shown in FIGS. 9 and 10, a plurality of round holes 37 extending laterally are formed on the contact faces between the upper and lower midsoles 3*a*, 3*b*. In the upper midsole 3*a* are formed a plurality of through holes 39, or vent holes, in connection with the lateral holes 37, extending vertically and having opening ends on the planter contact face 30 of the heel portion of the upper midsole 3*a*.

A tubular member 38 with annular cross section is inserted into each of the lateral holes 37. The tubular member 38 is formed of plastic or metal material in order to maintain the shape of the lateral hole 37. Also, the length of the tubular member 38 is adjusted such that it does not block the communicating portion that communicates with the through hole 39 inside the lateral hole 37. In the alternative, this communicating portion of the tubular member 38 may be formed with a notch in connection with the through hole 39.

In this case, the air is introduced into the inside of the shoe through the lateral hole 37 and the through hole 39 in communication with the lateral hole 37. Thus, ventilation can be attained inside the shoe, especially at the heel portion. Also, in this case, because the tubular member 38 maintains the shape of the lateral hole 37 so that the lateral hole 37 cannot be deformed to be crushed in the case of impact loading onto the midsole 3, ventilation inside the shoe can be secured.

In addition, a semi-circular or arcuate member can take the place of the tubular member 38 having annular cross section. Which shape of the member is used depends on the sectional shape of the lateral hole 37, but the shape of the member may be determined so as to conform to at least a portion of the sectional shape of the lateral hole 37.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet still fall within the scope of the invention.

What is claimed is:

1. The midsole assembly for an athletic shoe comprising:

a midsole formed of soft elastic material:

a corrugated sheet having corrugation, said corrugated sheet being interposed in at least the heel portion of said midsole;

a plurality of transverse holes formed at the regions where said midsole contacts with said corrugated sheet, said transverse holes extending in the shoe width direction;

a plurality of vent holes extending vertically and communicating with said transverse holes, said vent holes having open ends on the plantar contact face of said heel portion of said midsole;

a vertically extending through hole formed at the midfoot portion of said midsole;

a groove formed at the forefoot portion of said midsole, said groove extending longitudinally and communicating with said through hole;

a plurality of vent holes being open at the plantar contact face of said forefoot portion of said midsole, said vent holes extending vertically and communicating with said groove;

a concave portion formed at an opening portion of said through hole on the bottom side of said midfoot portion; and a cover portion formed at a portion of said corrugated sheet, said cover portion disposed oppositely to said opening portion of said through hole and covering a portion of said concave portion.

2. The midsole assembly according to claim 1, wherein said vent holes at said forefoot portion of said midsole are aligned in a general shoe width direction, and further comprising a transverse groove extending in said general shoe width direction on the bottom side of said forefoot portion and communicating with each one of said vent holes at said forefoot portion.

3. The midsole assembly according to claim 1, further comprising a midsole groove extending in a general shoe width direction on said midfoot portion of said midsole and communicating with said through hole.

4. A midsole assembly for an athletic shoe, comprising a midsole and a corrugated sheet, wherein:

said midsole consists essentially of at least one soft elastic material, includes a forefoot portion, a midfoot portion and a heel portion, and has a top surface adapted to face upwardly toward an upper of said shoe and a bottom surface adapted to face downwardly toward an outsole of said shoe;

said heel portion includes an upper heel portion and a lower heel portion;

said corrugated sheet includes at least a corrugated portion thereof that has a corrugated configuration and that is interposed between said upper heel portion and said lower heel portion, and a plantar arch portion that includes a cover portion and that is arranged on said bottom surface of said midfoot portion;

at least one transverse hole extends transversely in said heel portion of said midsole along said corrugated portion of said corrugated sheet and is open at least at one of a lateral side and a medial side of said heel portion;

at least one heel vent hole extends entirely vertically through said upper heel portion of said midsole from said at least one transverse hole to said top surface;

a concave recess is formed in said bottom surface of said midfoot portion of said midsole;

at least one midfoot vent hole extends entirely vertically through said midfoot portion of said midsole from said concave recess to said top surface;

at least one forefoot vent hole extends vertically in said forefoot portion of said midsole to said top surface of said forefoot portion;

at least one longitudinal groove extends longitudinally in at least said forefoot portion of said midsole and communicates between said at least one forefoot vent hole and said concave recess; and said cover portion of said corrugated sheet covers a portion of said concave recess below said at least one midfoot vent hole.

5. The midsole assembly according to claim 4, wherein said at least one transverse hole includes an upper transverse hole extending transversely in said upper heel portion of said midsole along an upper surface of said corrugated portion of said corrugated sheet.

6. The midsole assembly according to claim 5, wherein said at least one transverse hole further includes a lower transverse hole extending transversely in said lower heel portion of said midsole along a lower surface of said corrugated portion of said corrugated sheet.

7. The midsole assembly according to claim 6, wherein a first one of said transverse holes extends entirely transversely through said heel portion of said midsole and has open ends on said lateral side and said medial side of said heel portion, and a second one of said transverse holes has an open end only at said lateral side and extends only partly through said heel portion toward said medial side.

8. The midsole assembly according to claim 7, wherein said lower transverse hole is said first one of said transverse holes and said upper transverse hole is said second one of said transverse holes.

9. The midsole assembly according to claim 4, wherein said at least one transverse hole includes plural transverse holes, a first one of said transverse holes extends entirely transversely through said heel portion of said midsole and has open ends on said lateral side and said medial side of said heel portion, and a second one of said transverse holes has an open end only at said lateral side and extends only partly through said heel portion toward said medial side.

10. The midsole assembly according to claim 4, wherein said at least one transverse hole includes a lower transverse hole extending transversely in said lower heel portion of said midsole along a lower surface of said corrugated portion of said corrugated sheet.

11. The midsole assembly according to claim 10, wherein said at least one heel vent hole includes a first heel vent hole that further extends vertically through said corrugated portion of said corrugated sheet to communicate into said lower transverse hole.

12. The midsole assembly according to claim 11, wherein said at least one transverse hole further includes an upper transverse hole extending transversely in said upper heel portion of said midsole along an upper surface of said corrugated portion of said corrugated sheet, and said at least one heel vent hole further includes a second heel vent hole that does not extend vertically through said corrugated portion of said corrugated sheet and only communicates from said upper transverse hole upwardly to said top surface of said upper heel portion of said midsole.

13. The midsole assembly according to claim 4, wherein said corrugated sheet comprises a meshed sheet of metal fibers.

14. The midsole assembly according to claim 4, wherein said corrugated sheet comprises a corrugated solid metal sheet.

15. The midsole assembly according to claim 4, wherein said corrugated sheet comprises a fiber reinforced plastic sheet.

16. The midsole assembly according to claim 4, further comprising a midfoot transverse groove extending transversely across said midfoot portion of said midsole, along said plantar arch portion of said corrugated sheet, and communicating with said concave recess.

17. The midsole assembly according to claim 4, further comprising a forefoot transverse groove extending transversely across said forefoot portion of said midsole and communicating with said at least one forefoot vent hole.

18. The midsole assembly according to claim 4, wherein said cover portion has at least one hole therethrough which communicates into said concave recess and is not aligned vertically with said at least one midfoot vent hole.

* * * * *

UNITED STATES PATENT AND TRADEMARK OFFICE

CERTIFICATE OF CORRECTION

PATENT NO. : 6,393,732 B1
DATED : May 28, 2002
INVENTOR(S) : Kita

It is certified that error appears in the above-identified patent and that said Letters Patent is hereby corrected as shown below:

Title page,
Item [56], References Cited, FOREIGN PATENT DOCUMENTS, after "EP", replace "0 985 752 A1" by -- 0 958 752 A1 --

Signed and Sealed this

Twenty-ninth Day of October, 2002

*Attest:*

*Attesting Officer*

JAMES E. ROGAN
*Director of the United States Patent and Trademark Office*